US006273298B1

(12) United States Patent
Post

(10) Patent No.: US 6,273,298 B1
(45) Date of Patent: Aug. 14, 2001

(54) APPARATUS FOR DISPENSING VISCOUS FLUIDS FROM FLEXIBLE PACKAGES AND HOLDER FOR SUCH PACKAGES

(75) Inventor: Johannes Hermanus Nicolaas Post, Sassenheim (NL)

(73) Assignee: Fluid Management, Inc., Wheeling, IL (US)

( * ) Notice: Subject to any disclaimer, the term of this patent is extended or adjusted under 35 U.S.C. 154(b) by 0 days.

(21) Appl. No.: 09/520,606

(22) Filed: Mar. 8, 2000

(51) Int. Cl.[7] ..... B65D 35/56

(52) U.S. Cl. ..... 222/105; 222/135; 222/144; 222/325

(58) Field of Search ..... 222/105, 135, 222/144, 325

(56) References Cited

U.S. PATENT DOCUMENTS

| | | | | |
|---|---|---|---|---|
| 3,352,460 | * | 11/1967 | Herring | 222/138 X |
| 3,843,021 | * | 10/1974 | Schieser | 222/105 |
| 4,164,306 | * | 8/1979 | Perrin | 222/325 X |
| 4,856,676 | * | 8/1989 | Emody | 222/325 X |
| 5,114,045 | * | 5/1992 | Herpe | 222/105 |
| 5,452,825 | * | 9/1995 | Comstock et al. | 222/135 X |
| 5,474,212 | * | 12/1995 | Ichikawa et al. | 222/105 |
| 5,628,430 | * | 5/1997 | Barbe | 222/135 X |
| 5,730,327 | * | 3/1998 | Stern | 222/105 X |
| 5,938,078 | * | 8/1999 | Dorsey et al. | 222/105 X |
| 5,992,691 | | 11/1999 | Post et al. | 222/144 X |
| 6,003,731 | | 12/1999 | Post et al. | 222/144 X |
| 6,056,157 | * | 5/2000 | Gehl et al. | 222/105 X |

* cited by examiner

*Primary Examiner*—Kenneth Bomberg
(74) *Attorney, Agent, or Firm*—Marshall, O'Toole, Gerstein, Murray & Borun

(57) ABSTRACT

An apparatus for dispensing viscous fluids includes a turntable rotatable around an axis of rotation. A plurality of pumps are attached to and distributed around the axis of the turntable. The pumps each have a connector for releasably connecting a fluid package thereto for dispensing fluid therefrom and have associated first positioning members. A plurality of removable rigid holders is adapted to receive a flexible fluid package therein in a predetermined position. The holders include second positioning members adapted to coact with the first positioning members to enable placement of the holders onto the turntable such that the package received therein is connected to the respective connector.

19 Claims, 6 Drawing Sheets

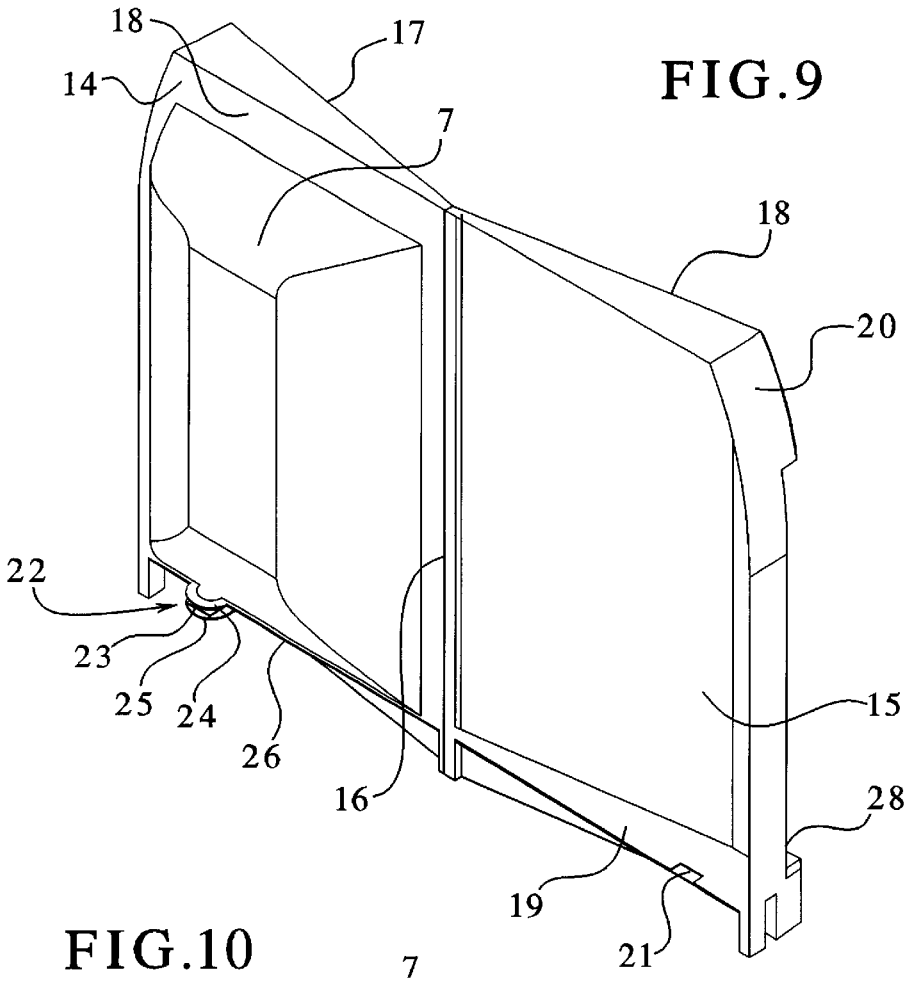
FIG.9
FIG.10
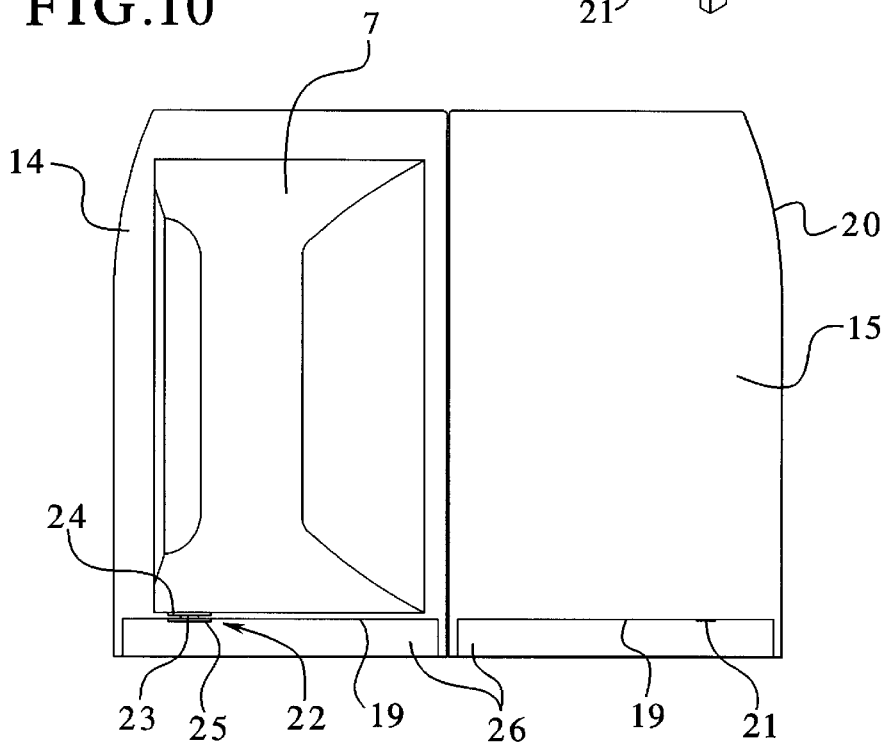

APPARATUS FOR DISPENSING VISCOUS FLUIDS FROM FLEXIBLE PACKAGES AND HOLDER FOR SUCH PACKAGES

BACKGROUND OF THE INVENTION

1. Field of the Invention

The present invention relates to an apparatus for dispensing viscous fluids from flexible packages and, more particularly, to an apparatus comprising holders for such packages.

2. Description of the Related Art A prior art apparatus of this type is known, for example, from U.S. Pat. No. 5,992,691. In this apparatus, the flexible packages consist of bags having a fitting which may be connected to a connector or conduit of an associated pump. If a package is empty, it can be replaced by removing it from the connector and mounting a new package thereon.

U.S. Pat. No. 6,003,731 discloses another prior art dispensing apparatus including a stationary actuator that facilitates the removal of an empty package.

SUMMARY OF THE INVENTION

An object of the present invention is to provide an improved apparatus in which the replacement of a flexible package is further facilitated.

The present invention provides an apparatus for dispensing viscous fluids which comprises a plurality of removable rigid holders adapted to receive a flexible fluid package therein in a predetermined position. The holders include second positioning members adapted to coact with first positioning members associated with the pumps. This enables placement of the holders onto the table such that the package received therein is connected to the respective connector.

According to the invention, it is not necessary to handle and manipulate the flexible package in order to mount it to the connector of a pump. The rigid holder surrounding the flexible package is easier to handle making it easier to place the package onto the connector by bringing the positioning members of the holder and table/pump into engagement.

Preferably, the holders are each formed as a rigid openable casing adapted to receive the flexible package therein. The holders have a bottom part or a wall part near the bottom including a retainer for fixing a dispensing part of the flexible package to the casing to obtain the predetermined position.

To further fascilitate the correct placement of the holders, there are provided guiding members for guiding the holder to a position in which the first and second positioning members engage and in which the dispensing part of the package is connected to the connector. The guiding members are formed on at least the holders, and in one embodiment, the guiding members are formed by the side walls of the holders. The horizontal section of the holders is configured as a sector of a circle or as a rectangle and the adjacent holders are positioned close to each other when placed on the table or to the support.

In this embodiment, the holders which are mounted on the support of the apparatus guide a holder which should be disposed between them. This configuration and arrangement of the holders not only leads to a proper guiding of the holders with simple means, but also enables an efficient use of the surface of the table so that a maximum number of packages can be mounted on a minimum table area.

Preferably, the casing of the holder has depressions in the side walls adjacent to the outer wall to enable the holders to be grasped from a row of closely placed holders on the table. This enables an easy handling of the holders despite the close placement of the holders next to each other with hardly any spacing.

The invention also includes a holder for a fluid package for use in an apparatus for dispensing fluids. This holder comprises a rigid openable casing adapted to receive a flexible fluid package therein. The casing includes a wall part near the bottom of the holder having a retainer for fixing a rigid dispensing part of the flexible package to the casing such that a dispensing opening in the dispensing part of the package opens to the exterior of the casing. The holder comprises positioning members to position the holder with respect to the apparatus such that the dispensing part of the packages is connected to a respective connector, as well as guiding members for guiding the holder to the position in which the dispensing part of the package is connected to the connector.

BRIEF DESCRIPTION OF THE DRAWINGS

The invention will hereafter be further explained in the following detailed description in which reference is made to the accompanying drawings.

FIGS. 9 and 10 are a perspective view and a side view, respectively, (on different scales) of the holder of FIGS. 7 and 8, in open condition showing the flexible package therein.

It should be understood that the drawings are not necessarily to scale and that the embodiments are sometimes illustrated by graphic symbols, phantom lines, diagramatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
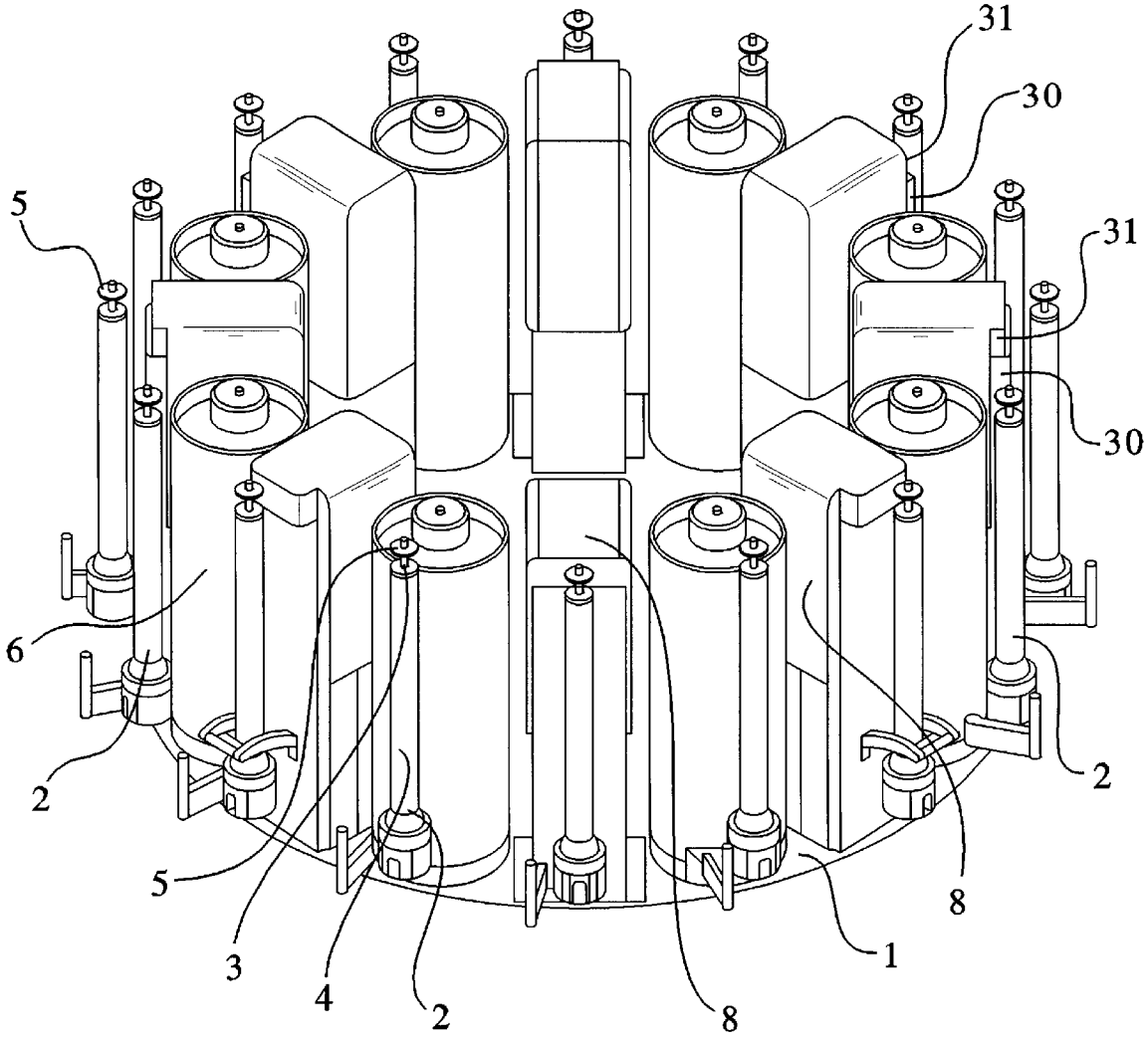
FIG. 1 is a perspective view of a part of an apparatus for dispensing viscous fluids in accordance with one embodiment of the present invention.
Figure 2:
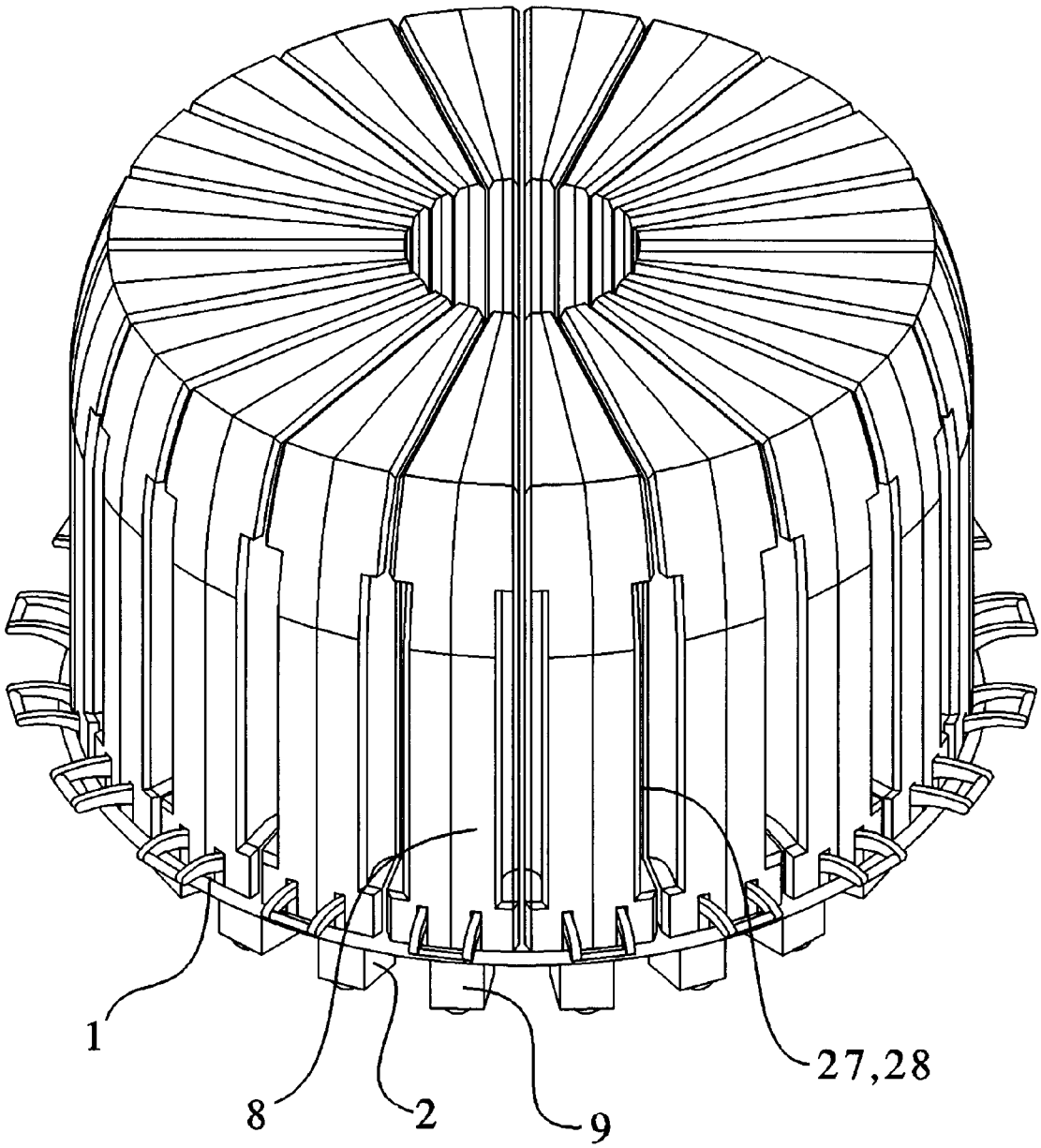
FIG. 2 is a perspective view of a part of an apparatus for dispensing fluids in accordance with a second embodiment of the present invention showing a turntable with a plurality of holders.

Turning first to FIG. 1, a part of an apparatus for dispensing viscous fluids is shown. This dispensing apparatus is an automated version and includes a turntable 1. This turntable 1 is rotatable about a vertical axis by means of a drive (not shown) in order to rotate the turntable 1 between descrete positions.

On the turntable 1, there is mounted a plurality of pumps 2, in this case sixteen pumps. In this embodiment, the pumps 2 are of the piston-type including a piston 3 having a lower end (not shown) disposed within a cylinder 4 of the pump and an upper end 5 that may be engaged by an actuator (not shown) adapted to move the piston 3 upward during an intake stroke and downward during a discharge stroke. The actuator is stationary and the turntable is adapted to position one of the pumps 2 in line with the actuator in order to enable it to actuate the pump. Each pump is associated with a fluid container, in this case two types of fluid containers: either a stationary type cannister 6 or a replaceable flexible package 7 (not shown) contained in a rigid, removable holder 8. When one of the cannisters 6 is empty or nearly empty, it should be refilled by pouring fluid, such as a paint component, into it. When a flexible package 7 is empty, the package and the holder 8 containing it can be removed, the holder 8 can be opened to take out the empty package and to insert a new, full one, whereafter the holder 8 and the full package 7 can be placed back in the original position.

Further features of the holder will be described with reference to FIGS. 2–10 showing a second embodiment of the apparatus and holders. FIGS. 2–6 again show a turntable 1 with a plurality of holders 8. In this case, the pumps are mounted below the turntable 1 and are not visible in the drawings. Visible are only valve blocks 9 which are in communication with the cylinders of the pumps and with the respective flexible package 7 when connected. The pump arrangement may be constructed like the embodiment that is disclosed in U.S. Pat. No. 6,003,731, the contents of which are incorporated herein by reference thereto.

FIGS. 3–6 show one connector or nipple 10 mounted on an associated positioning block which is aligned with the valve block 9. Around this positioning block 11, there is arranged a lifter 12 with a handle 13, the lifter being able to exert an upward force onto the lower side of a mounted holder when the handle 13 is depressed.

FIGS. 7–10 show one of the holders 8 separately, with a flexible package 7 contained therein. The holder 8 is configured as a rigid casing including two casing halves 14 and 15 which are connected through an integral, vertical hinge 16 connecting both halves to each other. The holder 8 has two side walls 17 and 18, a bottom wall 19 and an outer wall 20. When the holder 8 is in the closed position, the horizontal section of the holder casing is configured generally in the shape of a sector of a circle so that, when a plurality of holders 8, in this case twenty, are positioned side-by-side with the outer walls 20 circumferentially aligned, they form a ring. In the bottom wall 19 of each casing half 14, 15 there is formed a lateral recess in the edge of the bottom wall line 10 which forms the half of a hole which is created when the casing halves 14 and 15 are closed. This hole formed by the two recesses 21 functions as a retainer for holding a dispensing part 22 on the lower side of the flexible package 7. The dispensing part 22 has a body 23 fitting into the recesses 21 and an upper and lower flange 24 and 25 retaining the dispensing part 22 relative to the bottom wall 19 of the holder 8 in vertical direction. Extending through the dispensing part 22 is a dispensing opening which opens outside the holder 8 when the package 7 is mounted within the holder.

The bottom wall 19 of the holder 8 is positioned at a level above the lower end of the side walls 17 and 18, so that there is created a hollow fitting 26 over the positioning block 11 and thereby function as positioning means to position the holder 8 relative to the turntable 1.

Adjacent the outer wall 20 of the holder 8, there are created depressions 27and 28 in the side walls 17 and 18 of the holder allowing the introduction of fingers of a hand enabling one holder 8 in a row to be grasped with the fingers. This facilitates an easy removal of a holder 8.

Figure 3:
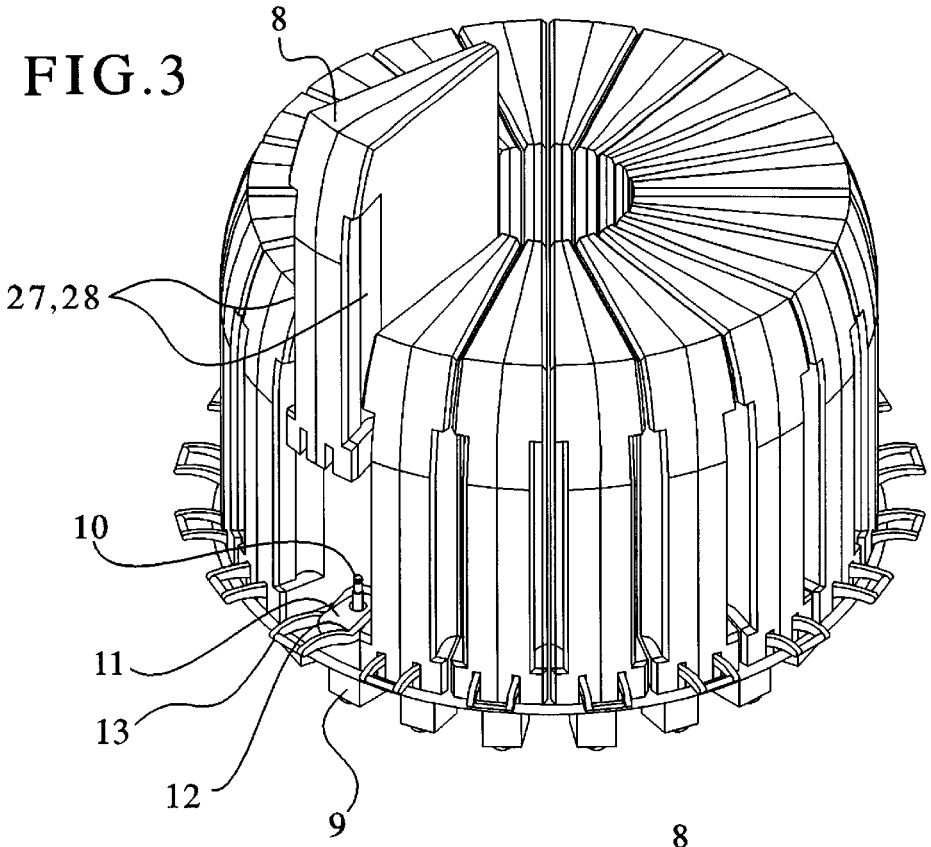
FIGS. 3 and 4 are a perspective view and a side view, respectively, of the turntable of FIG. 2 with one of the holders lifted for removal.
Figure 4:
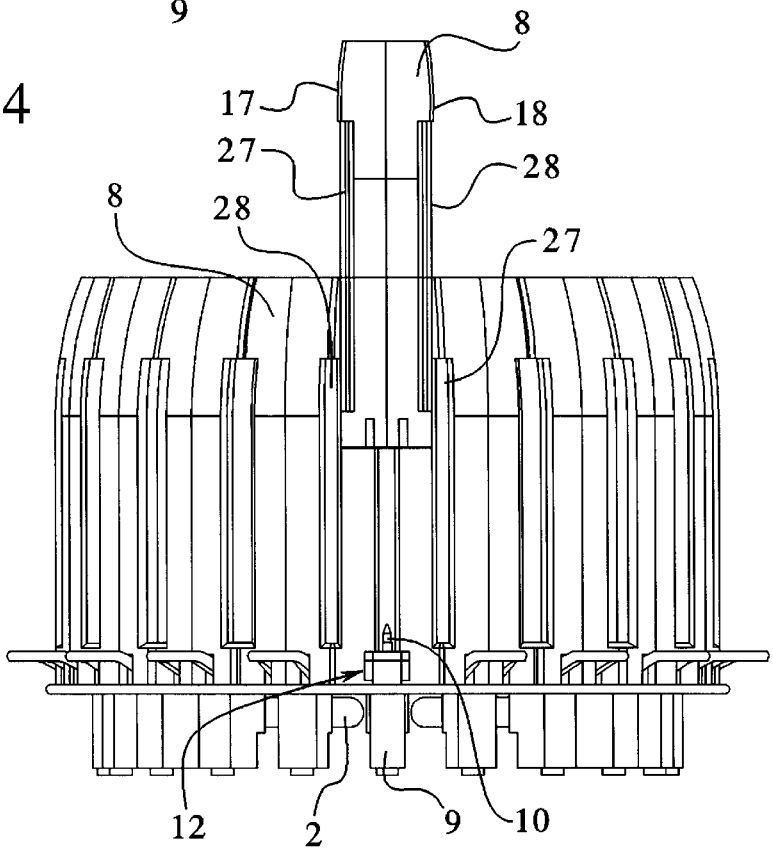
Figure 5:
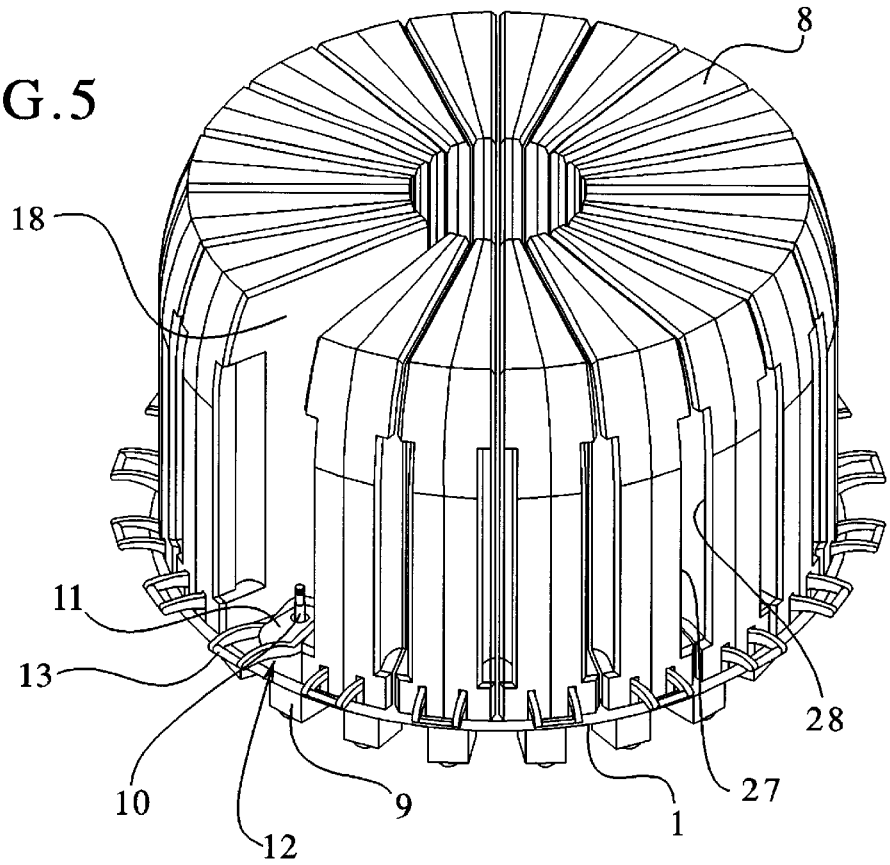
FIGS. 5 and 6 are views similar to those of FIGS. 3 and 4 with the holder completely removed.
Figure 6:
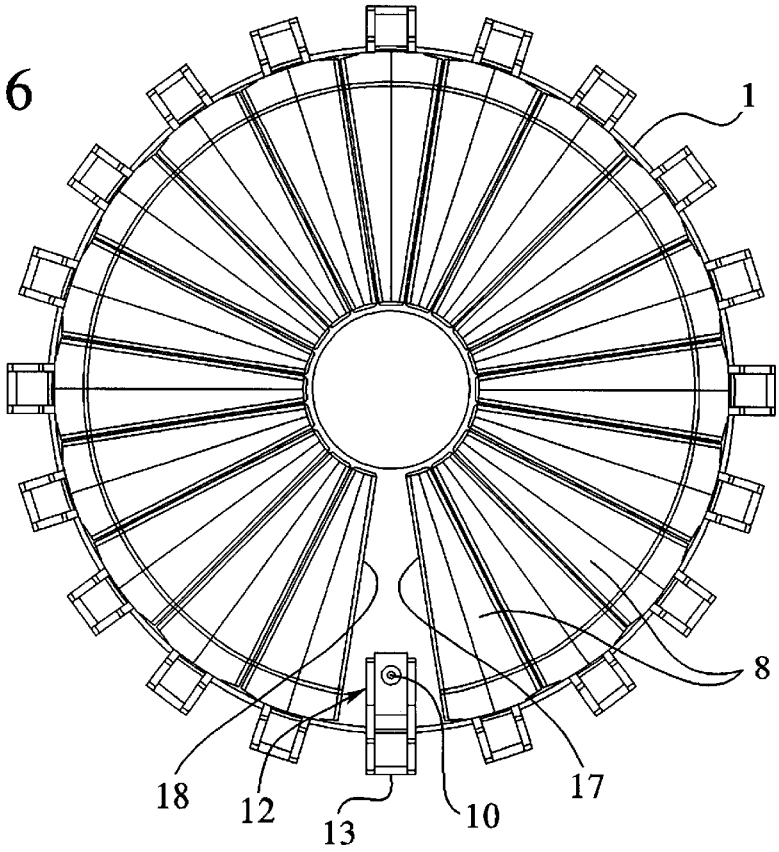
Figure 7:
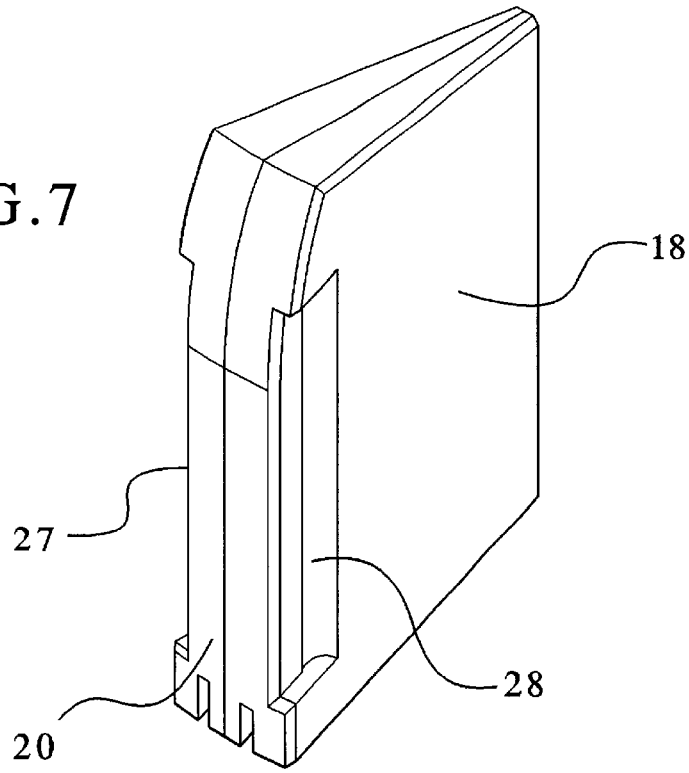
FIGS. 7 and 8 are a perspective view and a side view, respectively, of the holder of FIGS. 2–6, in closed condition.
Figure 8:
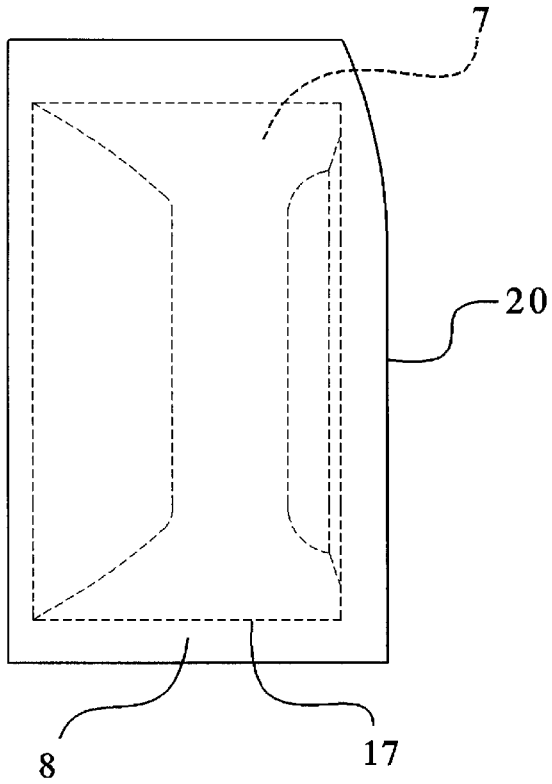

FIGS. 5 and 6 show a turntable 1 and holders 8 mounted thereon, wherein one holder 8 is removed. In FIGS. 3 and 4, one holder 8 is introduced in the free spacing between two holders 8 and this spacing is approximately equal to the outer size of a holder 8, so that the side walls 17 and 18 of the mounted holders 8 and the side walls 17 and 18 of the holder 8 to be mounted function as guiding members to position the dispensing part 22 above the connector 10 to guide the holder 8 downwardly towards the connector 10. When the holder 8 is almost in its lowest position, the hollow 26 fits over the positioning block 11 and the dispensing part 22 fits over the connector which is inserted into the dispensing opening of the flexible package 7. In the mounted position of the holder 8, the dispensing part 22 is locked on the connector 10 and the hollow 26 is positioned over the positioning block 11, so that the holder 8 and thereby the flexible package 7 is securely mounted on the turntable 1. The apparatus is now ready for use.

Returning to FIG. 1, it is shown that, in this embodiment, the guiding members for the holder 8 are configured as a vertical guide 30 on the turntable 1 in which a guiding part 31 of the holder 8 can engage in order to guide the holder 8 and the flexible package 7 contain therein to the correct position.

From the forgoing it will be clear that the invention provides an apparatus for dispensing fluids and a holder for use therein that are excellent regarding comfort of handling the flexible packages. The packages are very easy to replace and there is no risk of spillage of fluid.

The invention is not restricted to the embodiment shown in the drawing and described herein before, which may be varied in different manners within the scope of the invention. For example, it is possible to use a stationary or oscillating table to support the pumps and holders containing flexible packages. Such table may have a rectangular configuration. In this case the horizontal section of the holders will preferably also be rectangular. If the table or other support is stationary, the actuator may be movable, each pump may have its own actuator, or the pumps may be actuated manually.

In an embodiment wherein the pumps and the connectors are positioned at the side of the table, it might be preferable to use packages and holders having their dispensing parts and retainers in a rear wall near the bottom of the package and holder, respectively. In this case the holders will be guided to the connected position in a horizontal direction. Instead of a table as support, it is possible to use a vertical support member and locking members to secure the holders in their position.

I claim:

1. An apparatus for dispensing viscous fluids from a flexible fluid package, comprising:

a turntable rotatable around an axis of rotation;

a plurality of pumps attached to and distributed around the axis of the turntable, the pumps each having a connector for releasably connecting a flexible fluid package thereto for dispensing fluid therefrom and having associated first positioning members;

a plurality of removable rigid holders adapted to receive a flexible fluid package therein in a predetermined position and having second positioning members adapted to coact with the first positioning members to enable placement of the holders onto the turntable such that the flexible fluid package received therein is connected to a respective one of the connectors.

2. An apparatus according to claim 1, wherein the removable rigid holders are each formed as a rigid openable casing adapted to receive the flexible fluid package therein, and having a bottom part including a retainer for fixing a dispensing part of the flexible fluid package to the rigid openable casing to obtain the predetermined position.

3. An apparatus according to claim 2, further comprising:

guiding members for guiding the holder to a position in which the first and second positioning members engage and in which the dispensing part of the flexible fluid package is connected to the connector.

4. An apparatus according to claim 3, wherein the guiding members are formed on at least the removable rigid holders.

5. An apparatus according to claim 4, wherein the guiding members are formed by side walls of the removable rigid holders, a horizontal section of the removable rigid holders being configured as a sector of a circle, and adjacent ones of the removable rigid holders being positioned close to each other when placed on the turntable.

6. An apparatus according to claim 5, wherein the removable rigid holders further comprise an outer wall and wherein the rigid openable casing of the removable rigid holders has depressions in the side walls adjacent the outer wall to enable the removable rigid holders to be grasped from a row of removable rigid holders on the turntable.

7. An apparatus according to claim 5, wherein the first positioning members includes an elevation on the turntable surrounding the connector of each pump and the second positioning member includes a depression in a bottom wall of the removable rigid holder to fit over the elevation.

8. An apparatus according to claim 7, wherein the turntable is equipped with a lifting mechanism near each of the connectors adapted to engage the bottom wall of a respective one of the removable rigid holders and exert a lifting force thereon when actuated.

9. An apparatus for dispensing viscous fluids from a flexible fluid package, comprising:

a support having a central axis, a plurality of pumps attached to and circumferentially distributed on top of the support about the central axis thereof, the pumps each having a connector for releasably connecting a flexible fluid package thereto for dispensing fluid therefrom and having associated first positioning members, a plurality of removable rigid holders adapted to receive a flexible fluid package therein in a predetermined position and having second positioning members adapted to coact with the first positioning members to enable placement of the removable rigid holders to the support such that the flexible fluid package received therein is connected to a respective one of the connectors, each removable rigid holder being disposed between two of said pumps.

10. An apparatus according to claim 9, wherein the removable rigid holders are each formed as a rigid openable casing adapted to receive the flexible fluid package therein, and having a wall part near a bottom of the removable rigid holder, which includes a retainer for fixing a dispensing part of the flexible fluid package to the casing to obtain the predetermined position.

11. An apparatus according to claim 10, further comprising:

guiding members for guiding the removable rigid holder to a position in which the first and second positioning members engage and in which the dispensing part of the package is connected to the connector.

12. An apparatus according to claim 11, wherein the guiding members are formed on at least the removable rigid holders.

13. An apparatus according to claim 12, wherein the guiding members are formed by side walls of the removable rigid holders, and adjacent ones of the connectors are positioned such that adjacent ones of the removable rigid holders are close to each other when placed on the support.

14. An apparatus according to claim 13, wherein the removable rigid holders further comprise an outer wall and wherein the casing of the holders has depressions in the side walls adjacent the outer wall to enable the removable rigid holders to be grasped from a row of removable rigid holders on the support.

15. An apparatus according to claim 13, wherein the removable rigid holder further comprises a bottom wall and wherein the support is configured as a table and wherein the first positioning members include an elevation on the table surrounding the connector of each of the pumps and the second positioning members includes a depression in the bottom wall of the removable rigid holder to fit over the elevation.

16. An apparatus according to claim 15, wherein the table is equipped with a lifting mechanism near each of the connectors adapted to engage the bottom wall of a respective one of the removable rigid holders and exert a lifting force thereon when actuated.

17. An apparatus for dispensing viscous fluids from a flexible fluid package, comprising:

a support, a plurality of pumps attached to and distributed over the support, the pumps each having a connector for releasably connecting a flexible fluid package thereto for dispensing fluid therefrom and having associated first positioning members, a plurality of removable rigid holders adapted to receive a flexible fluid package therein in a predetermined position and having second positioning members adapted to coact with the first positioning members to enable placement of the removable rigid holders to the support such that the flexible fluid package received therein is connected to a respective one of the connectors, wherein the removable rigid holders are each formed as a rigid openable casing adapted to receive the flexible fluid package therein, and having a wall part near a bottom of the removable rigid holder, which includes a retainer for fixing a dispensing part of the flexible fluid package to the casing to obtain the predetermined position, and further comprising guiding members for guiding the removable rigid holder to a position in which the first and second positioning members engage and in which the dispensing part of the package is connected to the connector, the guiding members being formed on at least the removable rigid holders, the guiding members being formed by side walls of the removable rigid holders, and adjacent ones of the connectors being positioned such that adjacent ones of the removable rigid holders are close to each other when placed on the support, and wherein the removable rigid holders further comprising an outer wall and wherein the casing of the holders having depressions in the side walls adjacent the outer wall to enable the removable rigid holders to be grasped from a row of removable rigid holders on the support.

18. An apparatus for dispensing viscous fluids from a flexible fluid package, comprising:

a support, a plurality of pumps attached to and distributed over the support, the pumps each having a connector for releasably connecting a flexible fluid package thereto for dispensing fluid therefrom and having associated first positioning members, a plurality of removable rigid holders adapted to receive a flexible fluid package therein in a predetermined position and having second positioning members adapted to coact with the first positioning members to enable placement of the removable rigid holders to the support such that the flexible fluid package received therein is connected to a respective one of the connectors, wherein the removable rigid holders are each formed as a rigid openable casing adapted to receive the flexible fluid package therein, and having a wall part near a bottom of the removable rigid holder, which includes a retainer for fixing a dispensing part of the flexible fluid package to the casing to obtain the predetermined position, and further comprising guiding members for guiding the removable rigid holder to a position in which the first and second positioning members engage and in which the dispensing part of the package is connected to the connector, the guiding members being formed on at least the removable rigid holders, the guiding members being formed by side walls of the removable rigid holders, and adjacent ones of the connectors being positioned such that adjacent ones of the removable rigid holders are close to each other when placed on the support, and wherein the removable rigid holder further comprising a bottom wall and wherein the support being configured as a table and wherein the first positioning members including an elevation on the table surrounding the connector of each of the pumps and the second positioning members including a depression in the bottom wall of the removable rigid holder to fit over the elevation.

19. An apparatus for dispensing viscous fluids from a flexible fluid package, comprising:

a support, a plurality of pumps attached to and distributed over the support, the pumps each having a connector for releasably connecting a flexible fluid package thereto for dispensing fluid therefrom and having associated first positioning members, a plurality of removable rigid holders adapted to receive a flexible fluid package therein in a predetermined position and having second positioning members adapted to coact with the first positioning members to enable placement of the removable rigid holders to the support such that the flexible fluid package received therein is connected to a respective one of the connectors, wherein the removable rigid holders are each formed as a rigid openable casing adapted to receive the flexible fluid package therein, and having a wall part near a bottom of the removable rigid holder, which includes a retainer for fixing a dispensing part of the flexible fluid package to the casing to obtain the predetermined position, and further comprising guiding members for guiding the removable rigid holder to a position in which the first and second positioning members engage and in which the dispensing part of the package is connected to the connector, the guiding members being formed on at least the removable rigid holders, the guiding members being formed by side walls of the removable rigid holders, and adjacent ones of the connectors being positioned such that adjacent ones of the removable rigid holders are close to each other when placed on the support, wherein the removable rigid holder further comprising a bottom wall and wherein the support being configured as a table and wherein the first positioning members including an elevation on the table surrounding the connector of each of the pumps and the second positioning members including a depression in the bottom wall of the removable rigid holder to fit over the elevation; and wherein the table being equipped with a lifting mechanism near each of the connectors adapted to engage the bottom wall of a respective one of the removable rigid holders and exert a lifting force thereon when actuated.

* * * * *